US010280665B2

(12) United States Patent
Rieboldt et al.

(10) Patent No.: US 10,280,665 B2
(45) Date of Patent: May 7, 2019

(54) HINGE CLOSURE

(71) Applicant: EMKA Beschlagteile GmbH & Co. KG, Velbert (DE)

(72) Inventors: Gerd Rieboldt, Gevelsberg (DE); Jörg Skopnik, Sprockhövel (DE)

(73) Assignee: EMKA Beschlagteile GmbH & Co. KG, Velbert (DE)

( * ) Notice: Subject to any disclaimer, the term of this patent is extended or adjusted under 35 U.S.C. 154(b) by 0 days.

(21) Appl. No.: 15/750,419

(22) PCT Filed: Oct. 7, 2016

(86) PCT No.: PCT/EP2016/073954
§ 371 (c)(1),
(2) Date: Feb. 5, 2018

(87) PCT Pub. No.: WO2017/063945
PCT Pub. Date: Apr. 20, 2017

(65) Prior Publication Data

US 2018/0258675 A1 Sep. 13, 2018

(30) Foreign Application Priority Data

Oct. 15, 2015 (DE) ..... 10 2015 117 505

(51) Int. Cl.
*E05D 7/12* (2006.01)
*E05D 7/10* (2006.01)

(52) U.S. Cl.
CPC ..... *E05D 7/1061* (2013.01); *E05D 7/125* (2013.01); *E05Y 2600/50* (2013.01); *E05Y 2900/132* (2013.01)

(58) Field of Classification Search
CPC ..... Y10T 16/5357; Y10T 16/5358; Y10T 16/53607; E05D 2007/128; E05Y 2600/50;
(Continued)

(56) References Cited

U.S. PATENT DOCUMENTS 1,995,338 A * 3/1935 Andrews ..... E05B 85/22 292/164
2,703,431 A * 3/1955 Tatom ..... E05C 19/145 16/258
(Continued)

FOREIGN PATENT DOCUMENTS

EP 0043102 A1 * 1/1982 ..... B62D 33/033
WO 2006136939 A2 12/2006
WO 2012123776 A1 9/2012

*Primary Examiner* — Chuck Y Mah
(74) *Attorney, Agent, or Firm* — Johnson, Marcou & Isaacs, LLC; Jennifer S. Stachniak

(57) ABSTRACT

A hinge closure (1) includes a frame assembly (2) having a pin (3) for attachment to a door frame and a hinge assembly (4) rotatably mounted on the pin (3) with a door part (5) for attachment of the hinge assembly (4) to a door; a pivot part (6) mounted on the door part (5) so as to be pivotable about a pivot pin (7); and a slide (8) mounted exclusively in the door part (5). The slide (8) forms, together with the door part (5), a seat for the pin (3) of the frame assembly (2). The pivoting part (6), during pivoting out from the door part (5), contacts the slide (8) and displaces until reaching a venting state and to reach the removal state, the slide (8) must be further displaced manually against the spring preloading.

8 Claims, 5 Drawing Sheets

(58) Field of Classification Search
CPC ..... E05Y 2600/53; E05Y 2600/528; E05Y 2900/132
See application file for complete search history.

(56) References Cited

U.S. PATENT DOCUMENTS 2,778,053 A * 1/1957 Hess ..... E05D 7/1061 16/258
2,808,610 A * 10/1957 Minor ..... E05D 3/04 16/365
2,913,200 A * 11/1959 Paine, Jr. ..... F16M 5/00 16/258
2,974,354 A * 3/1961 Matuzas ..... D05B 75/06 16/258
3,406,995 A * 10/1968 McCarthy ..... E05D 7/1077 16/258
3,997,939 A * 12/1976 Wilhelmsen ..... E05D 1/04 16/261
4,482,023 A * 11/1984 Dziedzic ..... E05C 1/04 16/262
4,613,174 A * 9/1986 Berg ..... B61D 9/12 105/377.05
4,778,205 A * 10/1988 Sayre ..... E05B 17/2088 292/171
4,907,816 A * 3/1990 Dunand ..... A63C 9/20 280/615
6,082,352 A * 7/2000 Hsu ..... E05B 81/14 292/216
6,105,809 A * 8/2000 Yamanaka ..... B63B 17/02 114/364
6,594,860 B2 * 7/2003 Czipri ..... B63B 17/02 114/364
7,322,072 B2 * 1/2008 Lin ..... H05K 5/0221 16/252
7,401,380 B2 * 7/2008 Herring ..... H05K 5/0226 16/257
7,761,958 B2 * 7/2010 Alfredsson ..... E05D 7/1061 16/231
8,161,601 B2 * 4/2012 Alfredsson ..... E05D 7/1061 16/231
2001/0052705 A1 * 12/2001 Fisher ..... E05B 81/14 292/216
2018/0044957 A1 * 2/2018 Hoschler ..... E05D 7/1061

* cited by examiner

HINGE CLOSURE

CROSS-REFERENCE TO RELATED APPLICATIONS

The instant application should be granted the priority dates of Oct. 7, 2016, the filing date of the international patent application PCT/EP2016/073954, and Oct. 15, 2015, the filing date of German Patent Application DE 10 2015 117 505.3.

BACKGROUND OF THE INVENTION

The present invention relates to a hinge closure, including a frame assembly having a pin for attachment to a door frame and a hinge assembly rotatably mountable on the pin with a door part for attachment of the hinge assembly to a door, a pivot part mounted to the door part so as to be pivotable about a pivot pin, and a slide which is displaceably mounted in the door part, whereby the hinge assembly, in a hinging state, in which the pivot part is pivoted in the door part, is exclusively movable in rotation about the pin of the frame assembly and in a venting state, in which the pivot part is pivoted out of the door part, is movable transnationally transversely with respect to the pin of the frame assembly and is not yet completely removable from the pin of the frame assembly, and wherein the hinge assembly can be transferred against a spring preloading from the venting state into a removal state, in which the hinge assembly is completely removable from the frame assembly, by manually actuating the slide.

Such hinge assemblies are used with cabinets, whose interiors are under pressure. In order to avoid a door being pivoted unintentionally with a greater force based on the existing pressure when a latch is opened, first the excess pressure in the cabinet is released by venting. In this connection, the hinge can be mounted in a state in which the part of the hinge that is connected to the door can be moved at a predetermined distance relative to the frame of the cabinet.

A hinge closure with the above-noted features is disclosed in WO 2012/123776. With this hinge closure, the pivoting part and the door part form a seat for the pin of the hinge assembly in the hinging state. The door part and the pivoting part, then, are formed such that the hinge assembly is not displaceable transversely relative to the pin of the frame assembly when the pivoting part is pivoted into the door part. The sections of the pivoting part and the door part that form the seat are formed such that the entire hinge assembly is displaceable transversely relative to the pin, when the pivoting part is pivoted out sufficiently far from the door part. The pivoting pin of the pivoting part mounted in the door part must therefore cooperate with the pin of the frame assembly.

With the known hinge assembly, the spring preloaded slide is formed and arranged such that with when the pivoting part is pivoted out, the hinge assembly can be displaced transversely relative to the pin of the frame assembly only to a point that it moves with the slide into contact with the pin of the frame assembly. So that the hinge assembly can be removed completely from the pin of the frame assembly, the slide must be pulled back against the spring preloading so that the pulled-back slide can be directed with the hinge closure to the pin of the frame assembly.

With the above-described hinge closure, the slide is arranged asymmetrically in the door part, which results in the pressure being conducted unevenly in the hinge assembly in the venting state, which in turn could lead to uneven wear and tear.

SUMMARY OF THE INVENTION

The object of the present invention, therefore, is to solve the problems illustrated with regard to the state of the art and in particular, to provide a hinge assembly which is released uniformly in a venting state.

The object is solved in particular by a hinge closure with the above-noted features, whereby the slide is formed and arranged, such that the slide forms together with the door part a seat for the pin of the frame assembly in the hinging state and that the pivoting part is formed and arranged such that the pivoting pin of the pivoting part also is displaced in the hinging state relative to the pin of the frame assembly, wherein the pivoting part impacts the slide during pivoting out of the door part and moves until reaching the venting state and to reach the removal state of the slide, must be further displaced manually against the spring pre-tensioning.

The invention contemplates in is basic concept that the slide, in particular at its end, forms a part of the seat for the pin of the frame assembly, which surrounds the pin of the frame assembly, so that the hinge assembly is rotatable in the hinging state about the pin of the frame assembly. In order to release the seat for the pin, the slide is displaced first by the pivoted-out pivoting part to such a point that the hinge assembly is displaceable relative to the frame assembly, without having to remove the hinge assembly completely from the frame assembly. In this connection, the slide is formed at its end, such that after the displacement, the hinge assembly again contacts the pin of the frame assembly. The coupling between pivoting part and slide, therefore, is performed, such that the slide is displaced in the venting state only over a portion of its displacement path. In order to reach the removable state, the slide must be further displaced manually, until the pin of the frame assembly is completely released. In this manner, the slide can be arranged centrally in the door part, so that in the venting state, the forces can be conducted uniformly in the hinge assembly.

The slide has a section on its end facing the frame assembly, which contacts the pin of the frame assembly in the hinging stage and a section, which in the venting position, after displacement of the hinge assembly transversely to the pin of the frame assembly, contacts the pin.

Because of the displacement of the pivoting pin of the pivoting part of the hinge assembly relative to the pin of the frame assembly, also the (virtual) pivoting axis of the pivoting part never coincides with the axis of rotation of the hinge assembly, formed by the pin of the frame assembly. The pivoting pin of the pivoting part is displaced in the hinge state, in particular, parallel to the pin of the frame assembly. The hinge assembly, in addition, is formed such that a pivoting of the pivoting part results in a displacement of the slide, independently of whether the pivoting part is pivoted in or out.

In a preferred embodiment of the hinge closure, the slide has a first actuating projection, which cooperates with the pivoting part so that the pivoting part displaces the slide without spring preloading during pivoting. The slide, therefore, is positioned over the displacement path between a hinging state and venting state without spring preloading. The displacement of the slide between the two states, therefore, is based only on the displacement of the pivoting part, which cooperates with the first actuating projection.

In order to transfer the slide from the venting state into the removal state, a second actuating projection is provided, with which the slide is actuatable manually against a spring preloading. Without the manual impact, the slide therefore always moves based on the spring preloading from the removal state back into the venting state.

So that the hinge assembly is attachable again to the pin of the frame assembly without manual, independent actuation of the slide, the slide is chamfered on its end facing the frame assembly on its underside, so that the slide, upon attachment of the hinge assembly situated in the venting state to the frame assembly, is displaced by the pin against the spring preloading from the venting state. For re-attachment on the pin, the pivoting part, therefore, must be pivoted out from the door part of the hinge assembly. The chamfering of the slide, therefore, provides that the slide is displaced back by the forced applied during attachment. After the slide is moved to the pin of the frame assembly, this is displaced back into the venting state based on the spring preloading, so that the hinge assembly is attached to the frame assembly. Finally, the pivoting part must be pivoted into the door part, so that the hinge assembly is brought into the hinging state.

With the hinge closure known from the state of the art, it is disadvantageous that the distance of the pin of the frame assembly to the doorframe can be changed only by providing underlying support discs. In practice, based on, for example, the geometry of the frame or the mounting situation predetermined by the thickness of the seal, the position of the pin must be adjusted. It is therefore desirable that the distance from the pin to the frame can be adjusted in a simple manner during mounting. This problem is resolved independently from the above-described solution, in that the frame assembly includes a frame part for attachment of the frame assembly to the door frame and a door part forming the pin, which are connected to one another by means of an adjustment element, such that a distance or spacing of the pin to the door frame by means of the at least one adjustment element is adjustable. The previously described solution, therefore, is solved, in that the frame assembly comprises at least two elements, which are fixable to one another with the adjustment element in different positions.

In this connection, it is provided, in particular, that the at least one adjustment means is a screw, which is received through a through-hole in a frame part and engages in a threading formed in the pin part.

In one embodiment, it is therefore provided that the screw with a screw head having a height is arranged in a recess formed in a side of the frame part facing the hinge assembly and that the through-hole is an elongated hole or slot. With this type of arrangement, the distance of the pin to the frame can be adjusted, so that the screw is placed in different heights in the elongated hole or slot.

Alternatively, it can be provided in particular that the screw is introduced from the upper side into the frame assembly and is screwed into a nut on the underside of the frame part, the nut being arranged in a form-fitting manner in a recess on the underside of the frame part and having a height that corresponds to the depth of the recess. The distance of the pin to the frame, therefore can be changed easily, since the screw is easily accessible.

BRIEF DESCRIPTION OF THE DRAWINGS

The invention and technical field will be explained next with reference to the exemplary embodiment shown in the figures. In the figures.

DETAILED DESCRIPTION OF SPECIFIC EMBODIMENTS

Figure 1:
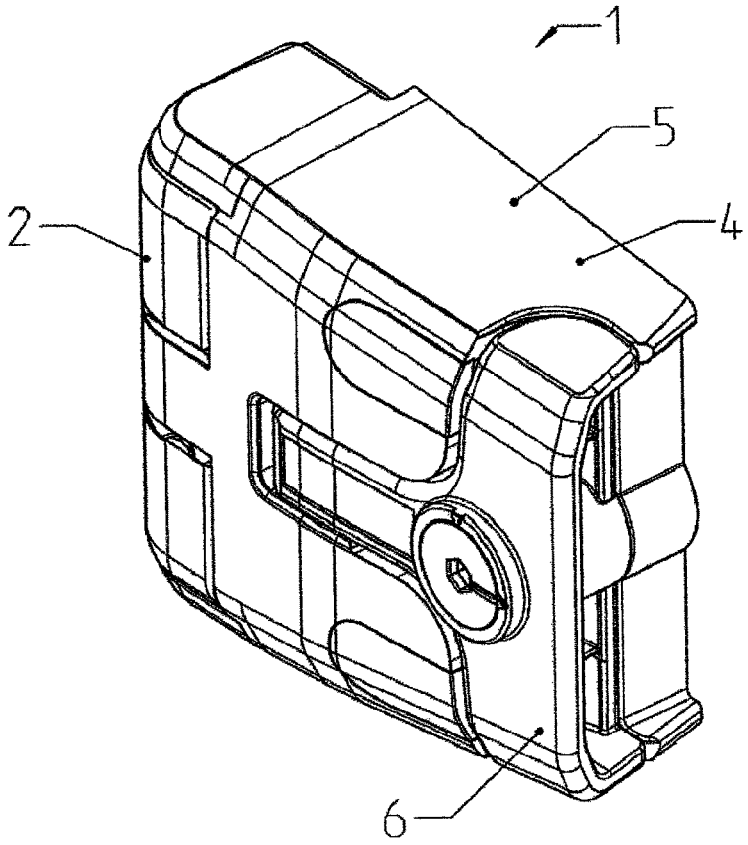
FIG. 1 shows a hinge closure.

FIG. 1 shows a hinge closure 1 with a frame assembly 2 and a hinge assembly 4, which includes a door part 5 and a pivoting part 6. During mounting to a cabinet, the frame assembly 2 is attached to a frame of the cabinet and the door part 5 of the hinge assembly 4 is attached to a door of the cabinet. In the hinging state shown in in FIG. 1 and FIG. 6, the hinge assembly 4 connected with the door is pivotable about a pin 3 formed by the frame assembly 2.

Figure 7:
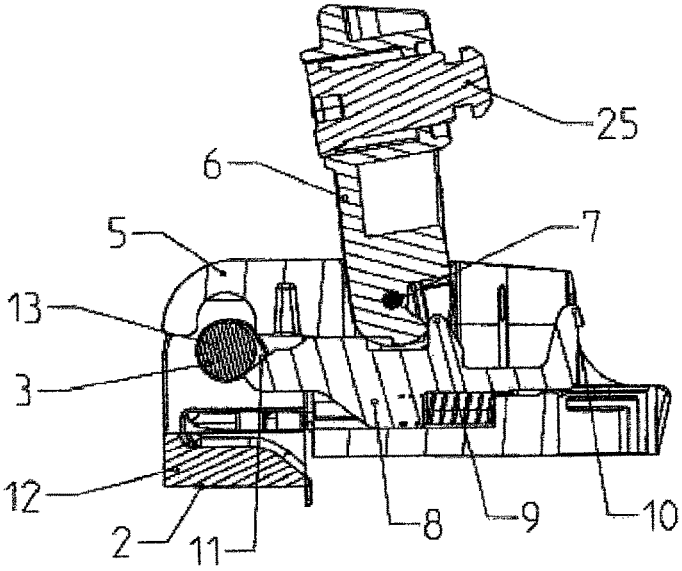
FIG. 7 shows the sectional view through the hinge closure in the ventilating state.
Figure 8:
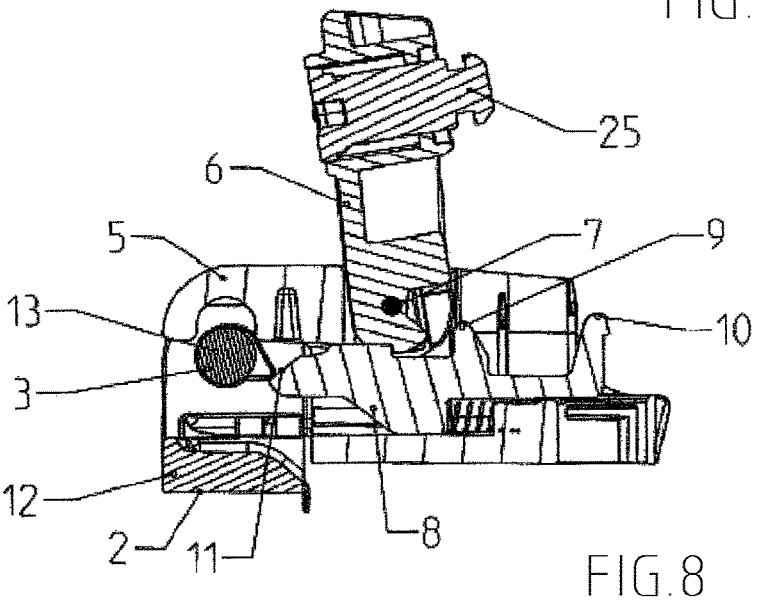
FIG. 8 shows the sectional view through the hinge closure in the removed state.

If the pivoting part 6 is pivoted out from the door part 5, then the hinge assembly 4 moves into a venting state (FIG. 7), in which the hinge assembly 4 is displaceable transversely to the pin 3 of the frame assembly 2, whereby the hinge group 4 is not yet completely removable from the frame assembly 2. So that the door that is connected with the hinge assembly 4 is removable completely from the frame, a slide 8 must be completely pulled backwardly, so that the pin 3 of the frame assembly 2 is completely released (FIG. 8).

Figure 2:
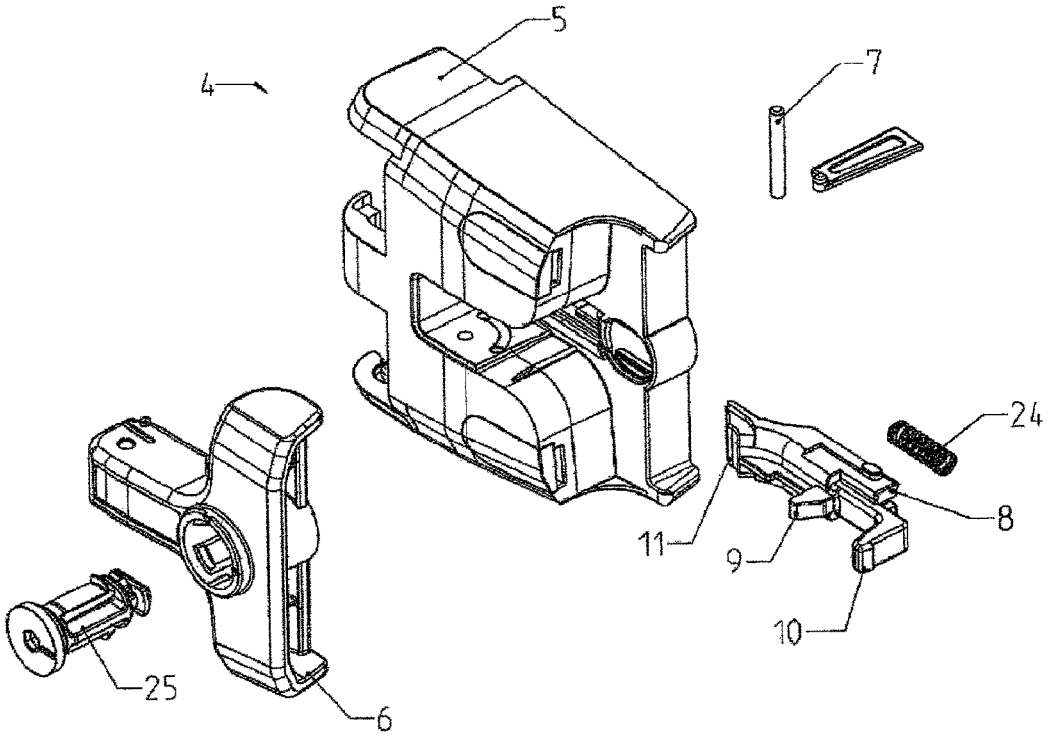
FIG. 2 shows an exploded view of a hinge assembly.

In FIG. 2, the components of the hinge assembly 4 are shown. The pivoting part 6 is pivotably mounted in the door part 5 by means of a pivot pin 7. The pivot pin 7 is thereby offset relative to a seat surrounding the pin 3 of the frame assembly 2. The pivoting part 6 can be secured in a state that is pivoted into the door part 5 by means of an interlock or pivot 25.

Figure 6:
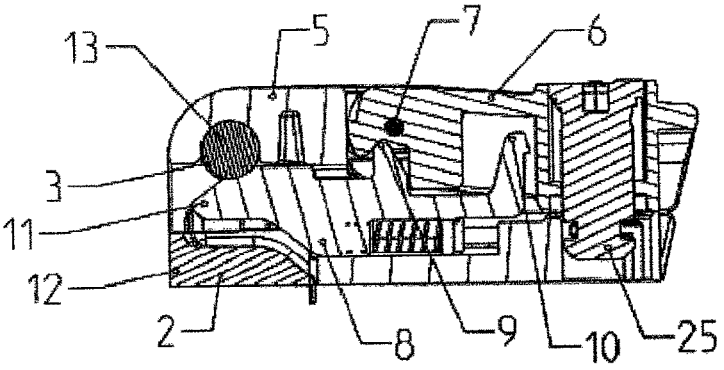
FIG. 6 shows a sectional view through the hinge closure in the hinging state.

The hinge assembly 4 further includes a slide 8, which is displaceably mounted in the door part 5. The slide 8 includes an end 11, which faces the frame assembly 2, a first actuating projection 9 and a second actuating projection 10. The slide 8, with its end 11, forms a part of the seat for the pin 3 of the frame assembly 2 in the hinging state (FIG. 6). The slide 8 is coupled with the pivoting part 6 via the first actuating projection 9, such that the slide 8 is pulled back during pivoting of the pivoting part 6 from the door part 5 from the pivoting state into the venting state, to such a point that the seat for the pin 3 is partially released. In the venting state, the hinge assembly 4 can be displaced transversely to the pin 3 of the frame assembly only to the point that the slide 8 comes into contact with its outermost end with the pin 3 (FIG. 7). In order to move the hinge assembly 2 into a removable state, the slide 8 must be shifted back by means of the second actuating projection 10 against a preloading provided by a spring 24, whereby the pin 3 of the frame assembly 2 is completely released (FIG. 8).

Figure 3:
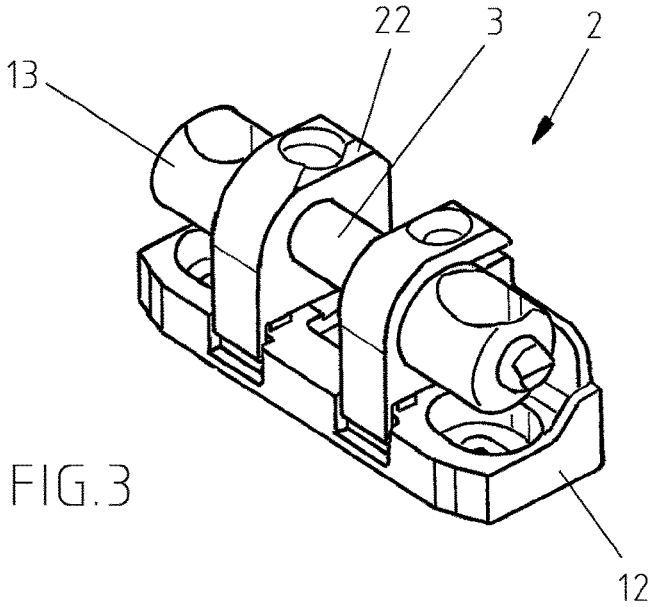
FIG. 3 shows a frame assembly.
Figure 4:
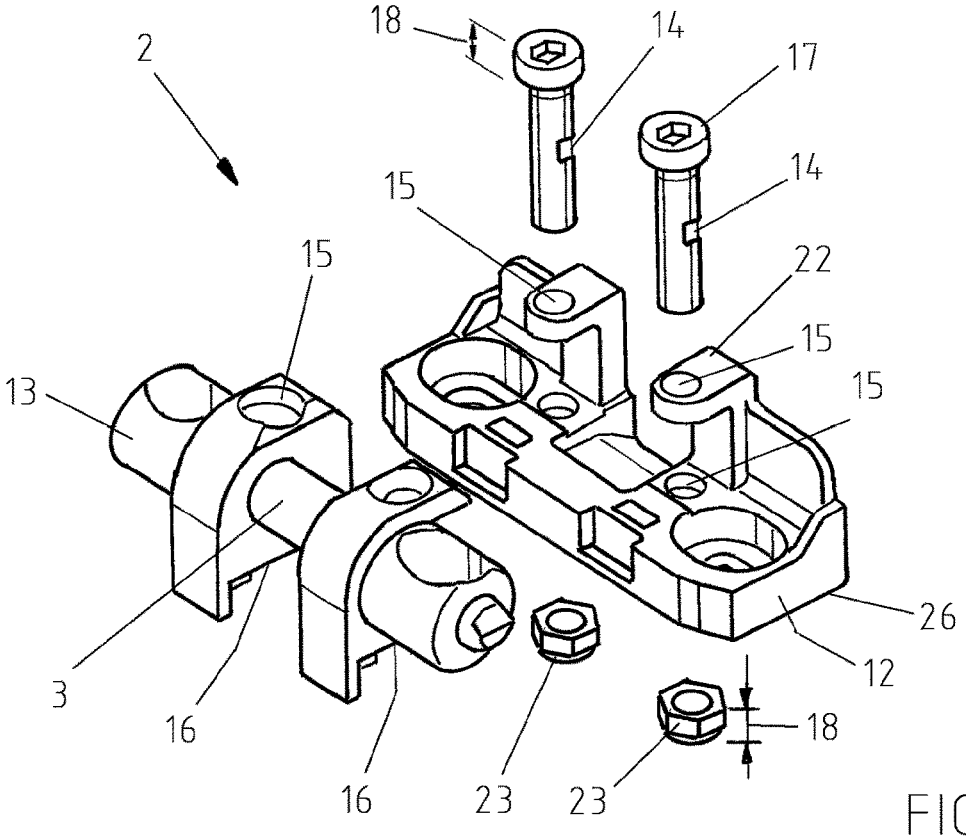
FIG. 4 shows an exploded view of the frame assembly.

In FIGS. 3 and 4, a first embodiment of a frame assembly 2 is shown. The frame assembly 2 includes a frame part 12 and a pin part 13. The frame part 12 and the pin part 13 are connected to one another by means of a screw 14, which is guided first from an upper side 22 through a through-hole 15 in the pin part 13 and then through a through-hole 15 in the frame part 12. Next, the screws 14 are screwed, respectively, into a threading 16 in the pin part 13 and engage through a through-hole 15 in the frame part 12. On the underside 26, recesses (not visible here) are formed, in which, respectively, a nut 23 is arranged and in which the screws 14 engage. The spacing of the pin 3 to a frame can be adjusted by actuating the screw 14.

Figure 5:
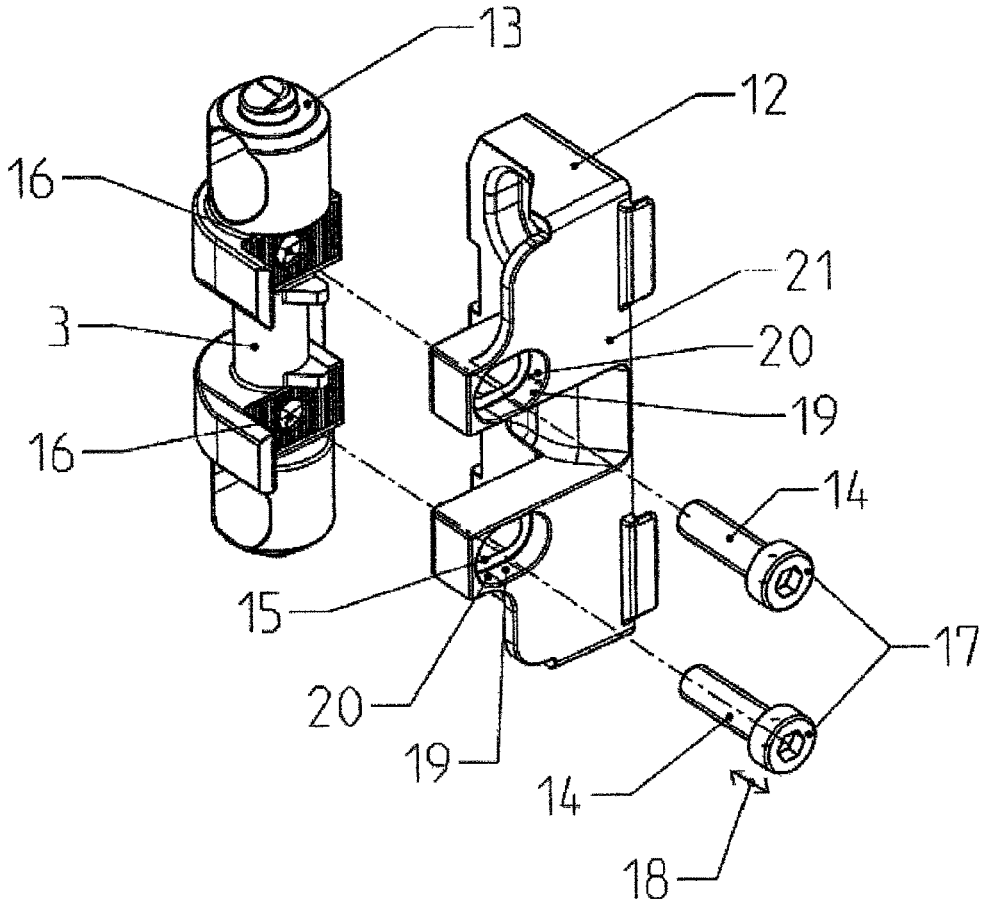
FIG. 5 shows an exploded view of a further frame assembly.

In FIG. 5, a further embodiment of the frame assembly 2 is shown. With this embodiment, the through-hole 15 is formed as an elongated hole or slot in a side 21 of the frame part 12, which, in the mounted state, faces the hinge assembly 4. The through-hole 15 is formed as an elongated hole or slot so that by the relative position of the screws 15 engaged in the threading 16 formed on the pin part 13, the distance of the pin 3 to the frame can be fixed. The screws 14 each have a screw head 17 with a height 18. The screw heads 17 are each arranged in a sinkhole described as a recess 19, whose depth 20 is at least as great as the height 18 of the screw head 17.

The specification incorporates by reference the disclosure PCT/EP2016/0-73954, filed Oct. 7, 2016, and DE 10 2015 117 505.3, filed Oct. 15, 2015.

The present invention is, of course, in no way restricted to the specific disclosure of the specification and drawings, but also encompasses any modifications within the scope of the appended claims.

REFERENCE NUMERAL LIST

1 hinge closure
2 frame assembly
3 pin
4 hinge assembly
5 door part
6 pivoting part
7 pivot pin
8 slide
9 first actuating projection
10 second actuating projection
11 end of slide
12 frame part
13 pin part
14 screw
15 through hole
16 threading
17 screw head
18 height
19 recess
20 depth
21 side facing the hinge assembly
22 upper side
23 nut
24 spring
25 interlock/pivot
26 underside

The invention claimed is:

1. A hinge closure (1), comprising:

a frame assembly (2) having a pin (3) for attachment to a door frame;

a hinge assembly (4) rotatably mounted on the pin (3) with a door part (5) for attachment of the hinge assembly (4) to a door;

a pivot part (6) mounted on the door part (5) so as to be pivotable about a pivot pin (7); and a slide (8) mounted exclusively in the door part (5), wherein the hinge assembly (4), in a hinging state in which the pivot part (6) is pivoted into the door part (5), is exclusively movable in rotation about the pin (3) of the frame assembly (2), and in a venting state, in which the pivoting part (6) is pivoted out from the door part (5), is movable translationally transversely with respect to the pin (3) and is not yet completely removable from the pin (3) of the frame assembly (3), and wherein the hinge assembly (4) is transferable against a spring preloading from the venting state into a removal state by manually actuating the slide (8), wherein, in the hinging state, the slide (8) forms, together with the door part (5), a seat for the pin (3) of the frame assembly (2), and wherein the pivot pin (7) of the pivoting part (6) is also offset from the pin (3) of the frame assembly (2) in the hinging state, wherein the pivoting part (6), during pivoting out from the door part (5) contacts the slide (8) and moves until reaching the venting state, wherein to reach the removal state, the slide (8) must be further displaced manually against the spring preloading.

2. The hinge closure (1) according to claim 1, wherein the slide (8) has a first actuating projection (9) that cooperates with the pivoting part (6), such that the pivoting part (6) displaces the slide (8) without spring preloading during pivoting.

3. The hinge closure (1) according to claim 2, wherein the slide (8) has a second actuating projection (10), wherein the slide (8) is transferable against the spring preloading from the venting state into the removal state via the second actuating projection (10).

4. The hinge closure (1) according to claim 1, wherein the slide (8) is chamfered on an underside on an end (11) facing toward the frame assembly (2), such that the slide (8), upon placement of the hinge assembly (4) in the venting state onto the frame assembly (2), is displaced against the spring preloading out of the venting state.

5. The hinge closure (1) according to claim 1, wherein the frame assembly (2) comprises a frame part (12) for attachment of the frame assembly (2) to the door frame and a pin part (13) forming the pin (3), wherein the frame part (12) and the pin part (13) are connected to one another via an adjustment element (14), such that a position of the pin (3) relative to the door frame is adjustable by means of the at least one adjustment element (14).

6. The hinge closure (1) according to claim 5, wherein the at least one adjustment element is a screw (14), wherein the screw (14) is received through a through-hole (15) in the frame part (12) and engages in a threading (16) formed in the pin part (13).

7. The hinge closure (1) according to claim 6, wherein the screw (14) is arranged in a recess (15) formed in a side (21) of the frame part (12) facing the hinge assembly (4), the screw (14) having a screw head (17) with a height (18).

8. The hinge closure (1) according to claim 6, wherein the screw (14) is inserted into the frame assembly (2) from an upper side (22) and screwed into a nut (23) on an underside (26) of the frame part (12), wherein the nut (23) is arranged in a form fit manner in a recess (19) on the underside (26) of the frame part (12), the screw head (17) having a height (18) that corresponds with a depth (20) of the recess (19).

* * * * *